US008851052B2

(12) United States Patent
Brox

(10) Patent No.: US 8,851,052 B2
(45) Date of Patent: Oct. 7, 2014

(54) METHOD AND CONTROL DEVICE FOR OPERATING AN INTERNAL COMBUSTION ENGINE

(75) Inventor: Oliver Brox, Korntal-Muenchingen (DE)

(73) Assignee: Robert Bosch GmbH, Stuttgart (DE)

( * ) Notice: Subject to any disclaimer, the term of this patent is extended or adjusted under 35 U.S.C. 154(b) by 489 days.

(21) Appl. No.: 12/931,109

(22) Filed: Jan. 24, 2011

(65) Prior Publication Data

US 2011/0308498 A1 Dec. 22, 2011

(30) Foreign Application Priority Data

Jan. 28, 2010 (DE) ..... 10 2010 001 309

(51) Int. Cl.
*F02M 51/00* (2006.01)
*F02D 35/02* (2006.01)
*F02D 41/30* (2006.01)

(52) U.S. Cl.
CPC ..... *F02D 41/3005* (2013.01); *F02D 35/023* (2013.01)
USPC ..... 123/478; 701/104; 123/299

(58) Field of Classification Search
CPC ..... F02D 41/3005; F02D 35/023
USPC ..... 123/445, 478, 480, 486, 472, 492, 493, 123/27 R, 299, 300, 435; 701/104
See application file for complete search history.

(56) References Cited

U.S. PATENT DOCUMENTS

| | | | | |
|---|---|---|---|---|
| 7,150,261 | B2 * | 12/2006 | Pfaeffle et al. | 123/299 |
| 7,337,059 | B2 * | 2/2008 | Pfaeffle et al. | 701/104 |
| 7,870,845 | B2 * | 1/2011 | Sasaki et al. | 123/435 |
| 8,239,120 | B2 * | 8/2012 | Mallebrein et al. | 701/104 |
| 2008/0162017 | A1 * | 7/2008 | Nagata et al. | 701/103 |
| 2009/0281710 | A1 * | 11/2009 | Mallebrein et al. | 701/104 |
| 2009/0299608 | A1 * | 12/2009 | Loeffler et al. | 701/104 |

* cited by examiner

*Primary Examiner* — Stephen K Cronin
*Assistant Examiner* — Elizabeth Hadley
(74) *Attorney, Agent, or Firm* — Kenyon & Kenyon LLP

(57) ABSTRACT

In a method for controlling operation of an internal combustion engine using a control device, a setpoint value of a first fuel injection quantity is specified for a first combustion cycle, and the first fuel injection quantity is injected. A combustion pressure is ascertained during the first combustion cycle, and in a further step, a setpoint value of a second fuel injection quantity is ascertained for a second combustion cycle based on the combustion pressure.

11 Claims, 2 Drawing Sheets

METHOD AND CONTROL DEVICE FOR OPERATING AN INTERNAL COMBUSTION ENGINE

BACKGROUND OF THE INVENTION

1. Field of the Invention

The present invention relates to a method for operating an internal combustion engine, especially a quality-controlled internal combustion engine, and also to a computer program product for executing the method and a control device for an internal combustion engine.

2. Description of the Related Art

The demands on modern internal combustion engines, particularly those used in vehicles, rise continuously, conditioned upon both legal boundary conditions with respect to admissible emission limits and increased expectational attitudes of end users with respect to travel comfort, smooth running and consumption. One fundamental approach to fulfilling these requirements is an exact control of fuel combustion. This takes place, for instance, in so-called quality-controlled internal combustion engines, which work according to the Diesel combustion method or a lean Otto combustion method, via a targeted, load-dependent control of the composition of the cylinder charge of fresh air and recirculated exhaust gas, as well as the injection quantity and the injection time of various types of fuel injections, which are set down in changing injection patterns.

One further growing requirement relates to the accuracy with which the internal combustion engine provides the requested torque over all conditions of load and environment. Special new vehicle power train types, which have hybrid drives and/or automatic transmissions having a large number of speeds set very high requirements on accuracy. The accuracy of the torque is determined mainly by the accuracy at which the engine efficiency is able to be ascertained, and by the accuracy at which fuel injection quantities are metered in. In this context, in particular, tolerances of the injection quantities in multiple injections, having high variability of the injection patterns and injection intervals, may become so great that the torque accuracies required of the abovementioned drive concepts can no longer be fulfilled.

BRIEF SUMMARY OF THE INVENTION

Accordingly, a method for operating an internal combustion engine is provided, in which first a setpoint value is specified of a first fuel injection quantity for a first combustion cycle of the internal combustion engine, and the first fuel injection quantity is injected. During the first combustion cycle, a combustion pressure is ascertained. In a further step, a setpoint value of a second fuel injection quantity for a second combustion cycle of the internal combustion engine is ascertained, based on the combustion pressure. This makes possible adjusting the setpoint value of the second fuel injection quantity according to the quality control in such a way that a desired torque is achieved at great accuracy.

From a broader point of view, the present invention creates a control device for controlling an internal combustion engine. The device includes a first setpoint value adjuster for specifying a setpoint value of a first fuel injection quantity for a first combustion cycle of the internal combustion engine, a control stage for injecting the first fuel injection quantity, a combustion pressure ascertainer for ascertaining the combustion pressure during the first combustion cycle, and a setpoint value ascertainer for ascertaining a setpoint value of a second fuel injection quantity for a second combustion cycle of the internal combustion engine, based on the combustion pressure.

According to one preferred refinement of the method according to the present invention, the injecting of the first fuel injection quantity and the ascertaining of the combustion pressure take place repeatedly for a plurality of combustion cycles. The ascertaining of the setpoint value of the second fuel injection quantity takes place based on the corresponding plurality of ascertained combustion pressure values during the plurality of the respective combustion cycles. The accuracy is further increased thereby, since a possible influence of statistical fluctuations of the combustion pressure is reduced via the plurality of combustion cycles.

According to one preferred refinement, a step of ascertaining is further provided as to whether the internal combustion engine is in a specifiable operating state. In this instance, the ascertaining of the combustion pressure takes place only if the internal combustion engine is in the specifiable operating state. This makes it possible further to increase the accuracy of the torque achieved, by specifying, as the specifiable operating state, such an operating state as the one in which an internal efficiency of the internal combustion engine is particularly exactly known.

According to another preferred refinement, the step of ascertaining the second fuel injection quantity includes sub-steps of calculating an actual value of the first fuel injection quantity based on the combustion pressure, of ascertaining a correction factor by comparing the specified first fuel quantity to the actual value, of specifying the setpoint value of the second fuel injection quantity, and of correcting the setpoint value using the correction factor. This calculating method is particularly efficient and simple to implement, especially in a control unit having limited calculating capacity.

The step of ascertaining the second fuel injection quantity preferably also includes sub-steps of storing the correction factor in a characteristics map as a function of at least one current fuel injection parameter, after the ascertaining of the correction factor, and of the reading out of the correction factor from the characteristics map as a function of the at least one current fuel injection parameter, before the correction of the setpoint value using the correction factor. This makes possible an additional increase in accuracy, since possible variations of the correction factor as a function of the at least one current fuel injection parameter are taken into account.

The current fuel injection parameter preferably has a current fuel pressure in a fuel pressure accumulator of the internal combustion engine and/or a current fuel injection pattern. This makes possible a further increase in accuracy, since the correction factor ascertained in typical internal combustion engines demonstrates a dependence on the fuel pressure in the fuel pressure accumulator of the internal combustion engine and of the fuel injection pattern.

DETAILED DESCRIPTION OF THE INVENTION

Figure 1:
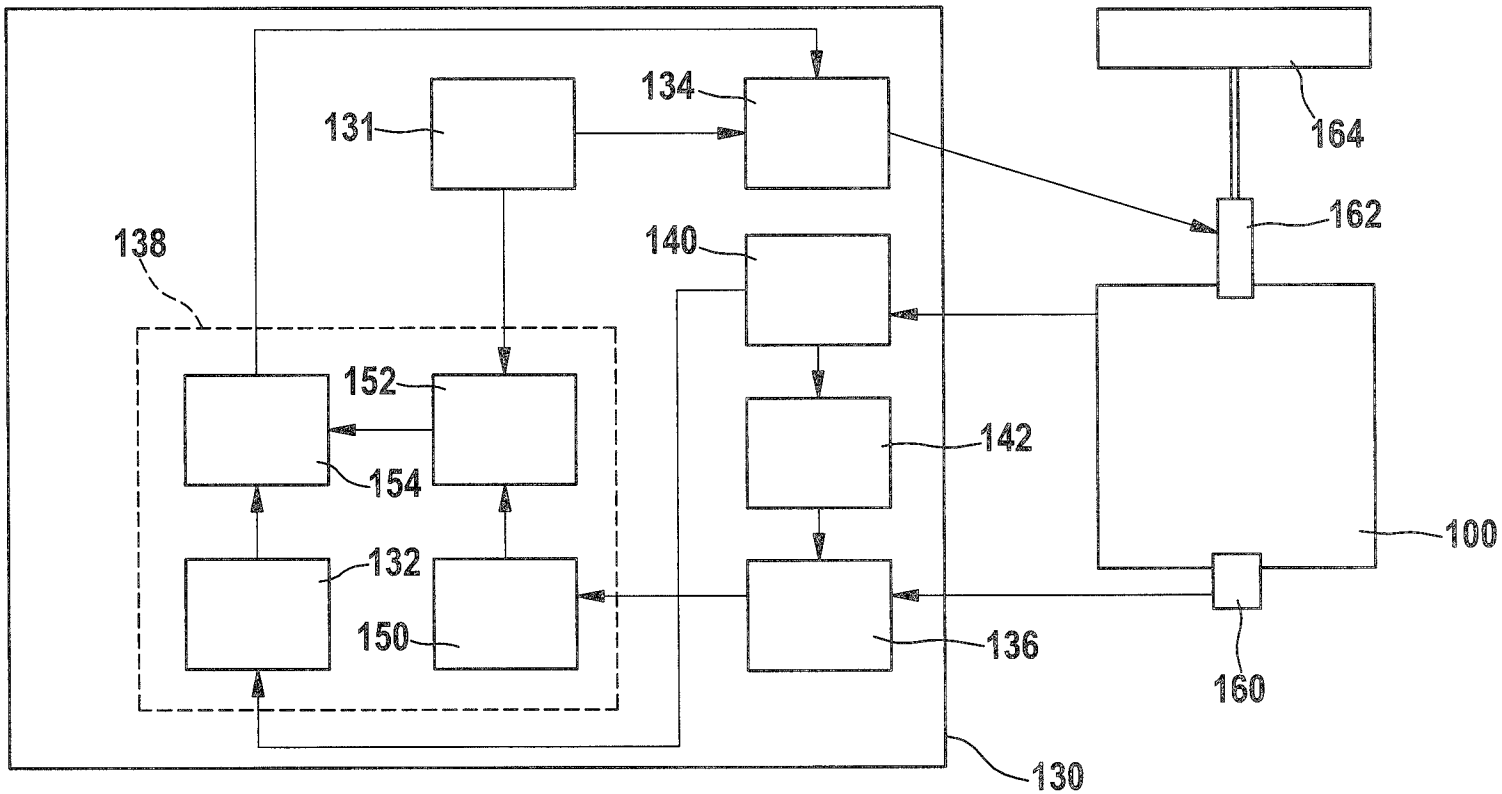
FIG. 1 shows a block diagram of an internal combustion engine having a control device according to one specific embodiment of the present invention.

In a schematic block diagram, FIG. 1 shows quality-controlled internal combustion engine 100 which, for instance, may be developed as a Diesel-powered engine. Internal combustion engine 100 has a fuel injection system having a fuel pressure accumulator 164 (rail), which is connected, via a pressure line, to a fuel injector 162 for injecting fuel that is under high pressure in fuel pressure accumulator 164 into a combustion chamber (not shown) of internal combustion engine 100. Internal combustion engine 100 has a combustion pressure sensor 160 for measuring a combustion pressure that is created after the ignition of the mixture obtained from the fuel injected by fuel injector 162.

A control unit 130 for controlling internal combustion engine 100 is connected via a plurality of signal paths to internal combustion engine 100. Control unit 130 has a control stage 134 for controlling fuel injector 162 in such a way that, depending on a fuel quantity signal received from the control stage, different fuel quantities are injected by fuel injector 162 into the combustion chamber of the internal combustion engine. Control stage 134 is connected to a first setpoint value adjuster 131 that is provided in control unit 130, for specifying 200 a setpoint value of a first fuel injection quantity.

Control unit 130 includes an operating state ascertainer 140 which ascertains an instantaneous operating state of the internal combustion engine based on, for example, data recorded on the internal combustion engine, such as instantaneous values of load, rotational speed, combustion air ratio $\lambda$, etc. In particular, operating state ascertainer 140 is developed to detect one or more specifiable operating states or ranges of operating states, in which an internal efficiency of the internal combustion engine, defined as the ratio of the inner torque and the injected fuel quantity is known at particularly high accuracy. For example, operating states during idling or ones having excess air $\lambda>1$ at a hot internal combustion engine 100 are specified to operating state ascertainer 140 for ascertainment.

Control unit 130 has a combustion pressure ascertainer 136, which is connected to combustion pressure sensor 160 of internal combustion engine 100 and is developed to ascertain the combustion pressure during a combustion cycle in which the first fuel quantity is injected corresponding to the setpoint value specified by first setpoint value adjuster 131. Between operating state ascertainer 140 and combustion pressure ascertainer 136, a combustion pressure ascertainer-activator 142 of the control unit is connected, which activates the combustion pressure ascertainer 136 when operating state ascertainer 140 has ascertained that internal combustion engine 100 is currently in the, or in one of the, specifiable operating states.

Combustion pressure ascertainer 136 is connected on the output side to an actual value computer 150 of control unit 130, to which it supplies the combustion pressure 136 ascertained. Based on the combustion pressure obtained and the internal efficiency known at great accuracy for the respective operating state, actual value computer 150 is developed to calculate an actual value of the first fuel injection quantity, which is able to deviate from the first setpoint value specified by first setpoint value adjuster 131. Control unit 130 also has a correction factor ascertainer 152 for ascertaining 205 a correction factor by comparing the setpoint value of the first fuel quantity specified by first setpoint value adjuster 131 to the actual value calculated by the actual value computer 150. The control unit optionally includes a memory, not shown in FIG. 1, for storing the correction factor, which may be developed, for instance, in the form of a learning characteristics map.

Control unit 130 furthermore includes a second setpoint value adjuster 132 for specifying 206 a setpoint value of a second fuel injection quantity which, for example, is required in an operating state of the internal combustion engine that is not among the specifiable operating states to be ascertained by operating state ascertainer 140. Second setpoint value adjuster 132 is connected on its output side to a setpoint value corrector 154, that is also provided in control unit 130, for correcting 207 the setpoint value using the correction factor. Consequently, setpoint value corrector 154, in common with second setpoint value adjuster 132, actual value computer 150 and correction factor ascertainer 152, forms a setpoint value ascertainer 138 for ascertaining a setpoint value of a second fuel injection quantity for a second combustion cycle of the internal combustion engine, based on the combustion pressure ascertained by combustion pressure ascertainer 136, during the first combustion cycle.

Figure 2:
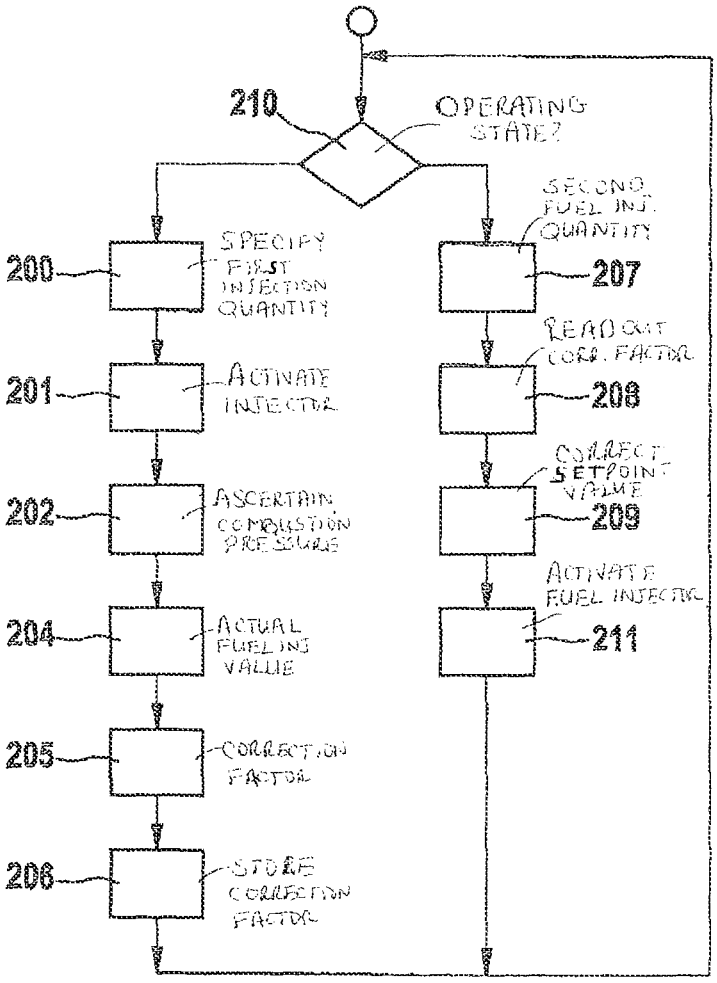
FIG. 2 shows a flow chart of a method for operating an internal combustion engine, according to one specific embodiment.

FIG. 2 shows a flow chart of a method for operating an internal combustion engine, for instance, internal combustion engine 100 shown in FIG. 1, while using control unit 130 shown in FIG. 1, for example.

First of all, it is judged, in a decision step 210, whether the internal combustion engine is in a specifiable operating state, for which there are accurate data about the internal efficiency of the internal combustion engine. If this is so, a setpoint value is specified, in step 200, of a first fuel injection quantity for a first combustion cycle of the internal combustion engine. This may be a function, for instance, of an instantaneous load situation and/or rotational speed situation and of the requirements of an operator of the internal combustion engine, and in step 201, a fuel injector of the internal combustion engine is activated, in order to inject the first fuel injection quantity into a combustion chamber of the internal combustion engine, and to carry out a first combustion cycle.

In step 202, a combustion pressure prevailing in the combustion chamber during the first combustion cycle is ascertained, using a combustion pressure sensor. In step 204, based on the combustion pressure, ascertained in step 202, and the internal efficiency of the internal combustion engine known exactly in the current operating state, an actual value is ascertained of the first fuel injection quantity. In step 205 a correction factor is ascertained, by comparing the setpoint value of the fuel quantity specified in step 200 to the actual value, for instance, by division of the setpoint value by the actual value.

Steps 200-204 may also be repeated several times, whereby in step 204 finally the correction factor is obtained, for instance, by averaging over a plurality of combustion cycles. Subsequently, the correction factor is stored in step 206, for instance, in a characteristics map, which provides different correction factors for different values of a pressure in the fuel injection system and/or different injection patterns. The method now jumps back to the beginning.

In the case in which it is ascertained in decision step 210 that the internal combustion engine is not in an operating state for which accurate data on the internal efficiency are at hand, the method branches after step 207, where a setpoint value is specified of a second fuel injection quantity, for a combustion cycle that is to be carried out subsequently. In step 208, the correction factor stored in step 206 is read out from the characteristics map, the currently valid parameters (such as fuel pressure and/or injection pattern) being made the basis. In step 209, the setpoint value specified in step 207 is corrected using the correction factor read out in step 208, for instance, multiplied by the correction factor. In step 211 the fuel injector is activated based on the corrected setpoint value, in order to inject the second fuel quantity with great accuracy. Thereafter the method jumps back to the beginning again.

What is claimed is:

1. A method for operating an internal combustion engine, comprising:

specifying a setpoint value of a first fuel injection quantity for a first combustion cycle of the internal combustion engine;

injecting the first fuel injection quantity;

ascertaining a combustion pressure during the first combustion cycle;

ascertaining a setpoint value of a second fuel injection quantity for a second combustion cycle of the internal combustion engine, based on the combustion pressure; and ascertaining whether the internal combustion engine is in a specified operating state corresponding to a known internal efficiency of the internal combustion engine;

wherein the ascertaining of the combustion pressure takes place only if the internal combustion engine is in the specified operating state.

2. The method as recited in claim 1, wherein the injecting of the first fuel injection quantity and the ascertaining of the combustion pressure take place repeatedly for a plurality of combustion cycles, and the ascertaining of the setpoint value of the second fuel injection quantity takes place based on the respective combustion pressure during the plurality of combustion cycles.

3. The method as recited in claim 1, wherein the ascertaining of the setpoint value of the second fuel injection quantity includes:

calculating an actual value of the first fuel injection quantity based on the combustion pressure;

ascertaining a correction factor by comparing the specified first fuel quantity to the actual value;

specifying the setpoint value of the second fuel injection quantity; and correcting the setpoint value of the second fuel injection quantity using the correction factor.

4. The method as recited in claim 3, wherein the ascertaining of the setpoint value of the second fuel injection quantity further includes:

storing the correction factor in a characteristics map as a function of at least one current fuel injection parameter, after the ascertaining of the correction factor; and reading out the correction factor from the characteristics map as a function of at least one current fuel injection parameter, before correcting the setpoint value of the second fuel injection quantity using the correction factor.

5. The method as recited in claim 4, wherein the current fuel injection parameter includes at least one of a current fuel pressure in a fuel pressure accumulator of the internal combustion engine and a current fuel injection pattern.

6. A non-transitory computer-readable storage medium storing a computer program having program instructions which, when executed on a computer, implement a method for operating an internal combustion engine, the method comprising:

specifying a setpoint value of a first fuel injection quantity for a first combustion cycle of the internal combustion engine;

injecting the first fuel injection quantity;

ascertaining a combustion pressure during the first combustion cycle; and ascertaining a setpoint value of a second fuel injection quantity for a second combustion cycle of the internal combustion engine, based on the combustion pressure; and ascertaining whether the internal combustion engine is in a specified operating state corresponding to a known internal efficiency of the internal combustion engine;

wherein the ascertaining of the combustion pressure takes place only if the internal combustion engine is in the specified operating state.

7. A control device for controlling an internal combustion engine, comprising:

a first setpoint value adjuster configured to specify a setpoint value of a first fuel injection quantity for a first combustion cycle of the internal combustion engine;

a control stage configured to control injecting the first fuel injection quantity;

a combustion pressure ascertainer for ascertaining a combustion pressure during the first combustion cycle;

a setpoint value ascertainer for ascertaining a setpoint value of a second fuel injection quantity for a second combustion cycle of the internal combustion engine, based on the combustion pressure;

an operating state ascertainer for ascertaining whether the internal combustion engine is in a specified operating state corresponding to a known internal efficiency of the internal combustion engine; and a combustion pressure ascertainer-activator for activating the combustion pressure ascertainer when the internal combustion engine is in the specifiable operating state.

8. The control device as recited in claim 7, wherein the setpoint value ascertainer includes:

an actual value computer for calculating an actual value of the first fuel injection quantity based on the combustion pressure;

a correction factor ascertainer for ascertaining a correction factor by comparing the specified first fuel quantity to the actual value;

a second setpoint value adjuster for specifying the setpoint value of the second fuel injection quantity; and a setpoint value corrector for correcting the setpoint value using the correction factor.

9. The method as recited in claim 1, wherein the internal efficiency corresponds to a ratio of an inner torque of the internal combustion engine and an injected fuel quantity.

10. The medium as recited in claim 6, wherein the internal efficiency corresponds to a ratio of an inner torque of the internal combustion engine and an injected fuel quantity.

11. The control device as recited in claim 7, wherein the internal efficiency corresponds to a ratio of an inner torque of the internal combustion engine and an injected fuel quantity.

* * * * *